US011686202B1

(12) United States Patent
Molnar, Jr.

(10) Patent No.: US 11,686,202 B1
(45) Date of Patent: Jun. 27, 2023

(54) ROTOR DAMPER WITH CONTACT BIASING FEATURE FOR TURBINE ENGINES

(71) Applicant: Rolls-Royce North American Technologies Inc., Indianapolis, IN (US)

(72) Inventor: Daniel E. Molnar, Jr., Lebanon, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 17/557,025

(22) Filed: Dec. 20, 2021

(51) Int. Cl.
*F01D 5/10* (2006.01)

(52) U.S. Cl.
CPC ..... *F01D 5/10* (2013.01); *F05D 2220/32* (2013.01); *F05D 2230/60* (2013.01); *F05D 2240/24* (2013.01); *F05D 2260/96* (2013.01)

(58) Field of Classification Search
CPC .... F01D 5/10; F05D 2220/32; F05D 2230/60; F05D 2240/24; F05D 2260/96
See application file for complete search history.

(56) References Cited

U.S. PATENT DOCUMENTS 4,192,633 A 3/1980 Herzner
4,361,213 A 11/1982 Landis et al.
4,846,628 A * 7/1989 Antonellis ..... F01D 11/006 416/221
5,211,407 A * 5/1993 Glynn ..... F01D 11/006 277/637
5,330,324 A * 7/1994 Agram ..... F01D 11/006 416/221
6,494,679 B1 12/2002 Gadre et al.
7,040,866 B2 * 5/2006 Gagner ..... F01D 5/3015 416/220 R
7,287,961 B2 * 10/2007 Broadhead ..... F04D 29/644 416/244 R
7,527,476 B2 * 5/2009 Butt ..... F01D 5/30 416/193 A
8,469,670 B2 * 6/2013 Fulayter ..... F04D 29/668 416/500
9,151,170 B2 * 10/2015 El-Aini ..... F01D 5/34
10,087,763 B2 10/2018 El-Aini et al.
10,184,345 B2 * 1/2019 Himes ..... F04D 29/322
10,196,896 B2 * 2/2019 Bryant ..... F01D 5/10
10,215,037 B2 * 2/2019 Caprario ..... F01D 5/3015
10,267,172 B2 * 4/2019 Leduc ..... F01D 5/22
10,329,913 B2 * 6/2019 Sadler ..... F01D 5/025
10,385,696 B2 8/2019 Edwards
10,408,233 B2 9/2019 Klauke
10,443,502 B2 10/2019 Edwards
2016/0298459 A1 10/2016 Bryant et al.
(Continued)

*Primary Examiner* — Igor Kershteyn
*Assistant Examiner* — Theodore C Ribadeneyra
(74) *Attorney, Agent, or Firm* — Barnes & Thornburg LLP

(57) ABSTRACT

A rotor assembly for a gas turbine engine includes a rotor extending circumferentially about a central axis. The rotor includes a ring that extends around the central axis and a mount that extends axially away from the ring. The ring includes an axially facing engagement surface. A blade extends radially outward from the ring of the rotor. A damper is coupled with the mount of the rotor and engaged with the engagement surface to minimize vibrations of the rotor assembly.

19 Claims, 7 Drawing Sheets

(56) References Cited

U.S. PATENT DOCUMENTS

| | | | | |
|---|---|---|---|---|
| 2016/0298460 | A1* | 10/2016 | Bryant | F01D 5/10 |
| 2017/0211592 | A1* | 7/2017 | Klauke | F04D 29/34 |
| 2017/0306772 | A1* | 10/2017 | Fulayter | F04D 29/668 |
| 2018/0230831 | A1* | 8/2018 | Kush | F01D 5/34 |
| 2019/0120255 | A1 | 4/2019 | Tomeo et al. | |

* cited by examiner

ROTOR DAMPER WITH CONTACT BIASING FEATURE FOR TURBINE ENGINES

STATEMENT REGARDING FEDERALLY SPONSORED RESEARCH OR DEVELOPMENT

Embodiments of the present disclosure were made with government support under Contract Nos. FA8650-19-D-2063 and FA8650-19-F-2078 award by the United States Air Force/Air Force Research Laboratory (AFRL). The government may have certain rights.

FIELD OF THE DISCLOSURE

The present disclosure relates generally to gas turbine engines, and more specifically to dampers for rotor assemblies used in gas turbine engines.

BACKGROUND

A rotor assembly for a gas turbine engine generally includes a rotor extending circumferentially about a central axis, wherein the rotor includes a blade extending radially outwardly from a mount of the rotor. A damper may be coupled to the mount of the rotor to minimize vibrations of the rotor assembly and attenuate rotor blade responses. However, the damper performance may vary with changing preload due to wear. That is, as the damper engages a ring of the rotor, the damper wears down such that material may be worn from the damper. Such wearing of the damper decreases contact force between the damper and the ring of the rotor over time, thereby reducing the damper's ability to minimize vibrations of the rotor assembly and attenuate rotor blade responses.

SUMMARY

The present disclosure may comprise one or more of the following features and combinations thereof.

According to a first aspect of the disclosed embodiments, a rotor assembly for a gas turbine engine includes a rotor extending circumferentially about a central axis. The rotor includes a ring that extends around the central axis and a mount that extends axially away from the ring. The ring includes an axially facing engagement surface. A blade extends radially outward from the ring of the rotor. A damper is coupled with the mount of the rotor and engaged with the engagement surface to minimize vibrations of the rotor assembly. The damper includes an inner band fixed with the mount. A damper body extends radially outward and axially into engagement with the engagement surface of the rotor. A projection extends axially from the damper body away from the engagement surface such that the projection is located axially between the engagement surface and the inner band.

In some embodiments of the first aspect, the damper body may include an outer band and an intermediate band. The outer band may extend substantially radially and may be engaged with the engagement surface. The intermediate band may extend radially and axially to interconnect the inner band and the outer band. The projection may be coupled with and may extend axially away from the outer band. The damper may include a locator lip that extends axially away from the inner band and the intermediate band in a direction opposite the projection. The projection may be coupled with and may extend axially away from the intermediate band. The projection may be substantially rectangular shaped. A radially outer-most edge of the projection may be flush with a radially outer-most edge of the damper body. The projection may be substantially L-shaped. The projection may be substantially T-shaped.

According to a second aspect of the disclosed embodiments, a rotor assembly for a gas turbine engine includes a rotor extending circumferentially about a central axis. The rotor includes a ring that extends around the central axis and a mount that extends axially away from the ring. A damper includes an inner band fixed with the mount. A damper body extends radially outward and axially into engagement with the ring of the rotor. A projection extends axially from the damper body away from the ring. The damper body includes an outer band and an intermediate band. The outer band extends substantially radially and is engaged with the ring. The intermediate band extends radially and axially between and interconnects the inner band and the outer band such that the projection and the intermediate band are located axially between the inner band and outer band.

In some embodiments of the second aspect, the projection may be coupled with and may extend axially away from the outer band. The damper may include a locator lip that extends axially away from the inner band and the intermediate band in a direction opposite the projection. The projection may be coupled with and may extend axially away from the intermediate band. The projection may be substantially rectangular shaped. A radially outer-most edge of the projection may be flush with a radially outer-most edge of the damper body. The projection may be substantially L-shaped. The projection may be substantially T-shaped.

According to a third aspect of the disclosed embodiments, a method of adapting a rotor assembly for a gas turbine engine includes providing a rotor that extends circumferentially around a central axis. The rotor has a ring and a mount that extends axially away from the ring. The method also includes providing a damper having an inner band. A damper body extends radially outward and axially away from the inner band. A projection extends axially away from the damper body. The projection is located axially between a terminal end of the damper body and the inner band. The method also includes fixedly coupling the inner band of a damper to the mount of the rotor to cause the damper body to engage the rotor and compress the damper body between the ring and the mount.

In some embodiments of the third aspect, the projection may include a first segment that extends axially and a second segment that extends radially away from the first segment. The projection may be flush with a radial outermost portion of the damper body.

These and other features of the present disclosure will become more apparent from the following description of the illustrative embodiments.

DETAILED DESCRIPTION OF THE DRAWINGS

Figure 1:
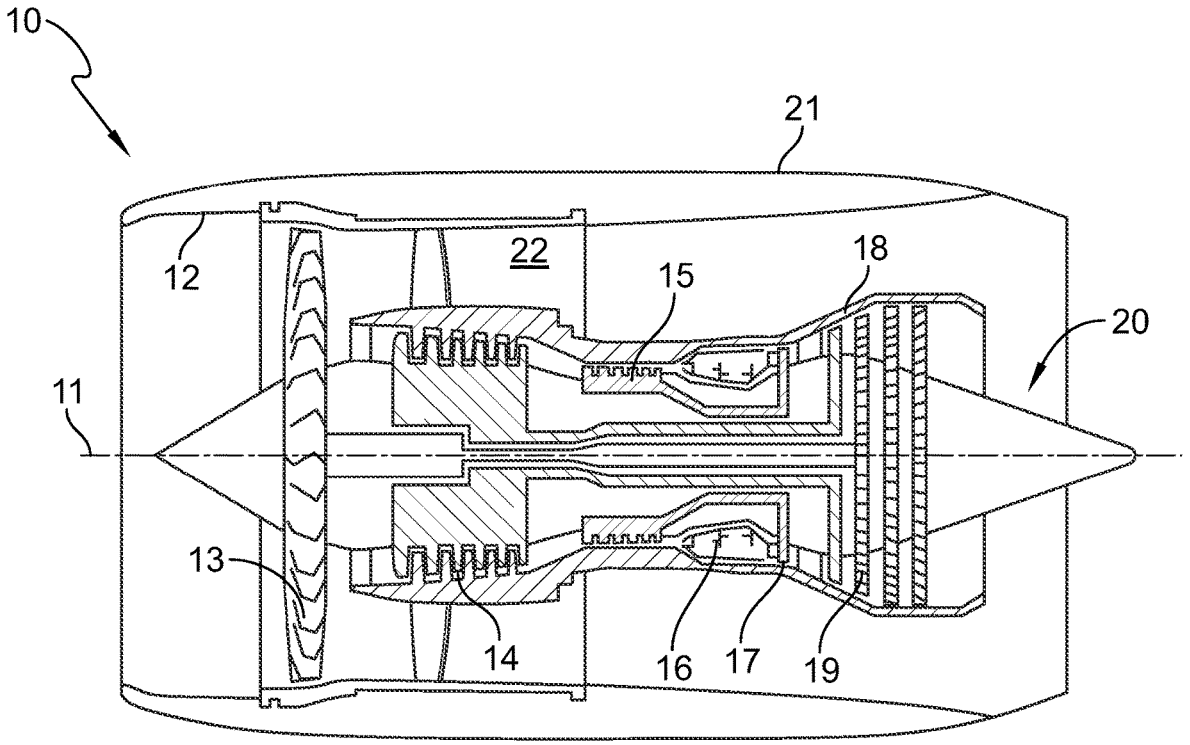
FIG. 1 is a sectional side view of a gas turbine engine in accordance with the present disclosure.

For the purposes of promoting an understanding of the principles of the disclosure, reference will now be made to a number of illustrative embodiments illustrated in the drawings and specific language will be used to describe the same.

With reference to FIG. 1, a gas turbine engine is generally indicated at 10, having a principal and central axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19, and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Each of the high 17, intermediate 18 and low 19 pressure turbines and each of the fan 13, intermediate pressure compressor 14 and high pressure compressor 15 comprises at least one rotor stage having multiple blades (or aerofoils) that rotate in use. One or more rotor stage may be, for example, a disc with slots (which may be referred to as dovetail slots or fir-tree slots) for receiving the blade roots. One or more rotor stages may have the blades formed integrally with the supporting disc or ring structure, and may be referred to as blisks or blings. In such arrangements, the blades may be permanently attached to the supporting disc/ring, for example using friction welding, such as linear friction welding.

Figure 2:
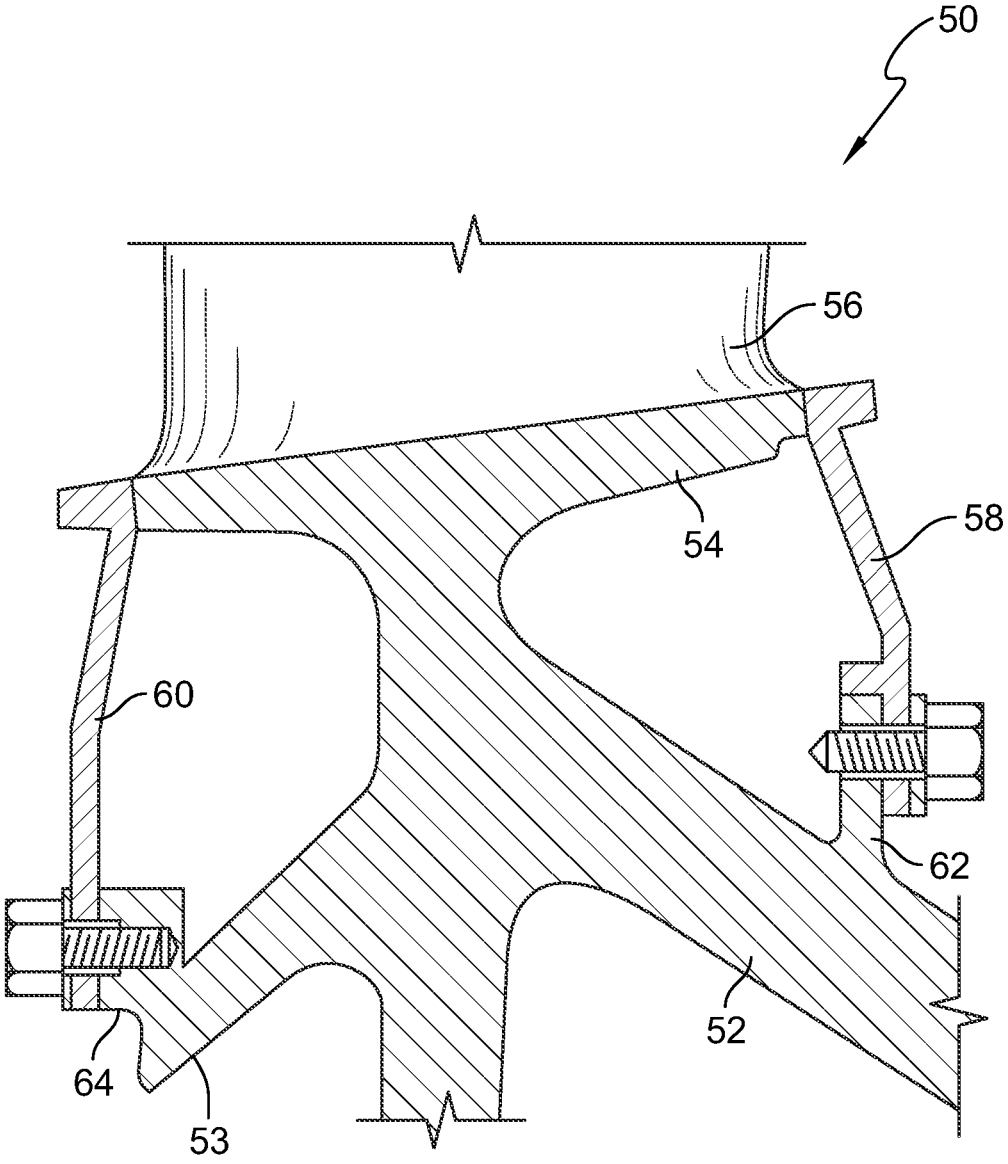
FIG. 2 is a schematic view of a portion of a rotor assembly of the gas turbine engine of FIG. 1, including a bladed rotor and a damper in accordance with the present disclosure coupled with the bladed rotor.

FIG. 2 shows a schematic side view of a part of a rotor assembly 50 for one of the rotor stages in the gas turbine engine. The rotor assembly 50 including an aft mount 52, a fore mount 53, a ring 54, a blade 56, an aft damper 58, and a forward damper 60. The mount 52, mount 53, ring 54, and blade 56 may all be integral, and may be referred to collectively as a blisk. The rotor assembly 50 may be any one of the rotor stages of the gas turbine engine 10 shown in FIG. 1, such as (by way of non-limitative example) the fan 13 and/or any one or more stages of one or more of the high 17, intermediate 18 and low 19 pressure turbines and/or the high pressure compressor 15 or intermediate pressure compressor 14.

The aft damper 58 is coupled to an axial downstream surface 62 of the aft mount 52 and the forward damper 60 is coupled to an axially upstream surface 64 of the fore mount 53. The dampers 58 and 60 are configured to engage a respective aft engagement surface 66 and forward engagement surface 68 of the ring 54 to minimize vibrations of the rotor assembly 50 and to attenuate responses of the blade 56. It will be appreciated that the rotor assembly 50 may include either the aft damper 58 and/or the forward damper 60. It will be further appreciated that the dampers described in FIGS. 3-10 may be embodied as either the aft damper 58 and/or the forward damper 60.

Figure 3B:
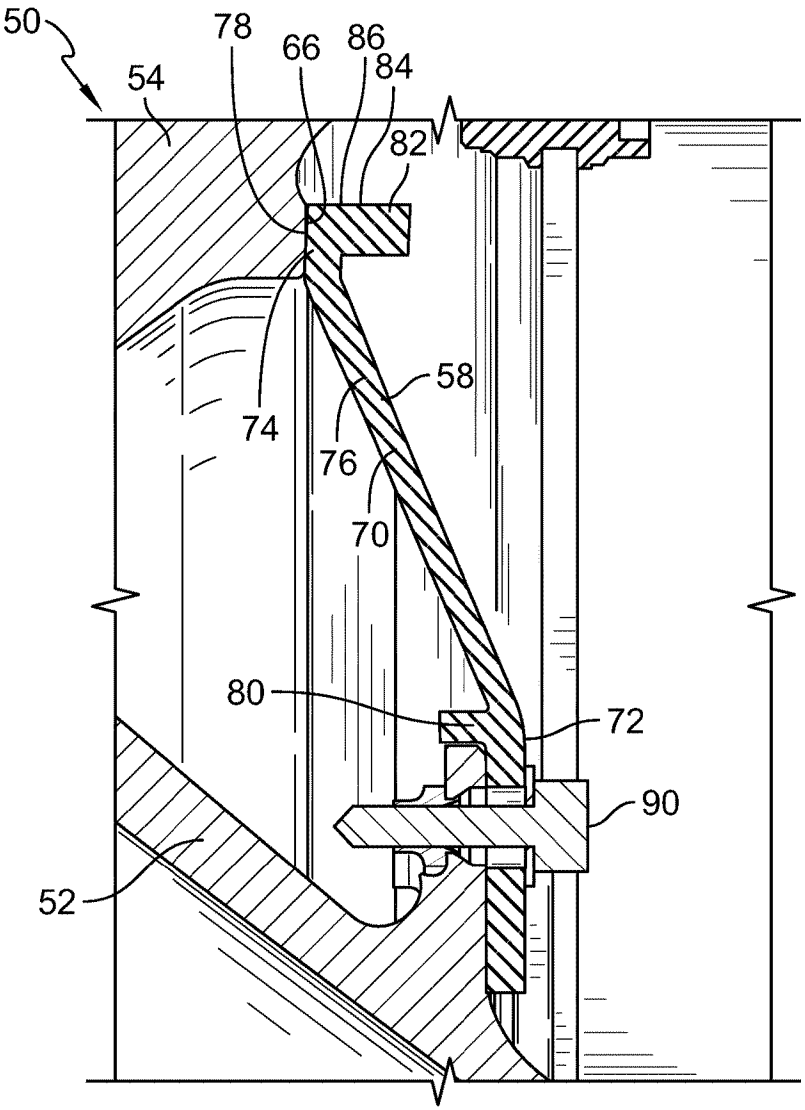
FIG. 3B is a perspective view of the rotor assembly of FIG. 2 with the damper fastened to the rotor to close the gap between the components.
Figure 3A:
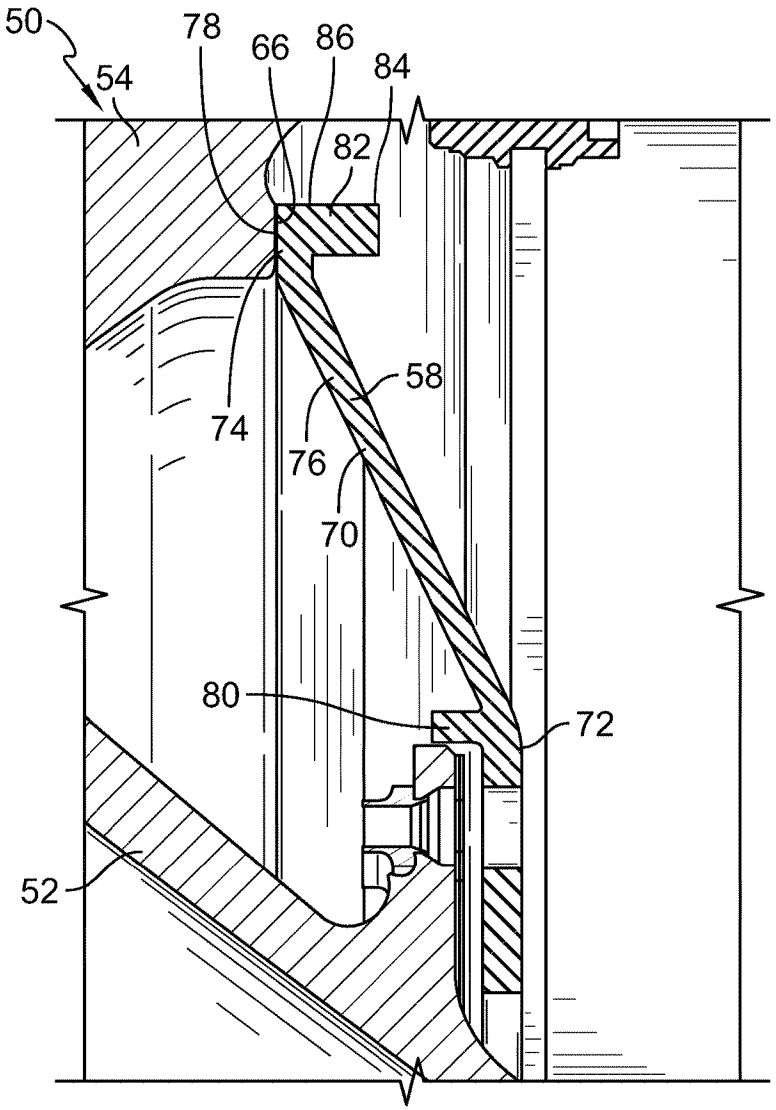
FIG. 3A is a perspective view of the rotor assembly of FIG. 2 showing that the damper includes a rectangular projection extending from an outer band of the damper and suggesting that the damper is yet to be coupled to the rotor such that a gap is formed between the components.

Referring now to FIGS. 3A and 3B, the rotor assembly 50 extends circumferentially around the central axis 11 and is configured to rotate about the central axis 11. The rotor assembly 50 includes the ring 54 having an axially facing engagement surface 66. The aft mount 52 is positioned radially inward from the ring 54 and extends axially away from the ring 54 and radially inward. The blade 56 (not shown in FIG. 3, but as illustrated in FIG. 2) extends radially outward from the ring 54.

The aft damper 58 is coupled to the aft mount 52 by a fastener 90 (shown in FIG. 3B) and includes a damper body 70, an inner band 72, an outer band 74, and an intermediate band 76. The outer band 74 includes a contact face 78. The inner band 72 is fixed to the mount 52 and the contact face 78 of the outer band 74 engages with the engagement surface 66 to minimize vibrations of the rotor assembly 50. That is, the damper body 70 extends radially outward from the mount 52 and axially into engagement with the engagement surface 66 of the rotor assembly 50. The intermediate band 76 extends radially and axially from the inner band 72 to interconnect the inner band 72 and the outer band 74. In the illustrated embodiment, the intermediate band 76 is located axially between the inner band 72 and the outer band 74. The outer band 74 extends radially from the intermediate band 76. A locator lip 80 extends axially away from the inner band 72 and the intermediate band 76 to position the damper 58 on the mount 52.

A projection 82 extends axially from the damper body 70 to reinforce contact between the contact face 78 of the outer band 74 and the engagement surface 66 of the rotor assembly 50. In the embodiment of FIGS. 3A and 3B, the projection 82 is formed integrally with the damper 58. In other embodiments, the projection 82 may be bonded to the damper 58. The projection 82 is substantially rectangular shape and a radially outer-most edge 84 of the projection 82 is flush with a radially outer-most edge 86 of the outer band 74 of the damper body 70.

It will be appreciated that the projection 82 may be positioned radially inward on the outer band 74 of the damper body 70 so that the radially outer-most edge 84 of the projection 82 is not flush with the radially outer-most edge 86 of the outer band 74 of the damper body 70. In the illustrated embodiment, the projection 82 is coupled to and extends axially away from the outer band 74 opposite the contact face 78 of the outer band 74. In some embodiments, the projection 82 extends axially from the outer band 74 in a direction opposite the locator lip 80. The projection 82 is located axially between the outer band 74 and the inner band 72. In the illustrated embodiment, the projection 82 is located axially between the engagement surface 66 of the outer band 74 and the inner band 72.

The projection 82 is sized (to add offset weight) and positioned to roll the outer band 74 of the damper 58 toward the rotor assembly 50 to retain contact between the contact face 78 of the outer band 74 and the engagement surface 66 of the rotor assembly 50 even as the contact face 78 wears. The projection 82 urges then radial outer end of the damper 58 axially toward the ring 54 due to the weight of the projection being acted on by centripetal forces and the projection 82 being located between the outer band 74 and the inner band 72.

Figure 4:
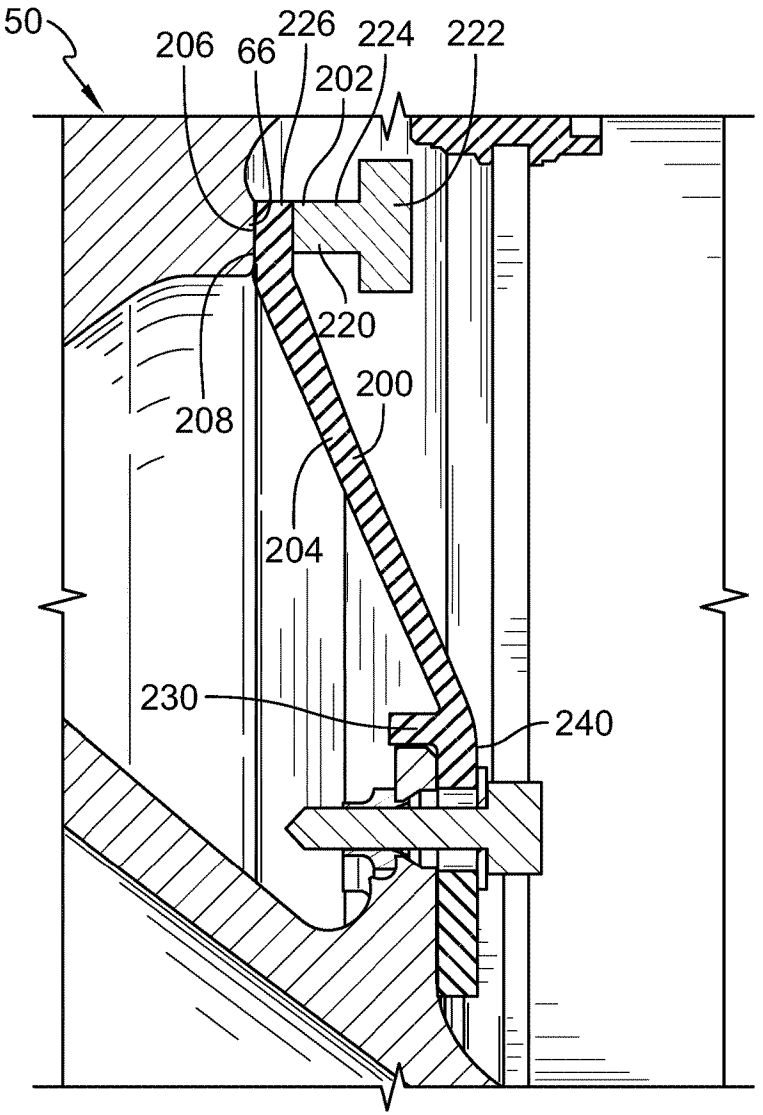
FIG. 4 is a perspective view of another damper, in accordance with another embodiment, including a T-shaped projection extending from the outer band of the damper.

FIG. 4 illustrates another embodiment of the damper rotor assembly 50 having a damper 200 with a projection 202 extending axially from a damper body 204 to reinforce contact between a contact face 206 of an outer band 208 and an engagement surface 66 of the rotor assembly 50. In the embodiment of FIG. 4, the projection 202 is bonded to the damper 200. In other embodiments, the projection 202 may be formed integrally with the damper 200. The projection 202 is substantially T-shaped and includes a first segment 220 extending axially from the outer band 208 and a second segment 222 extending both radially inward and radially outward from the first segment 220. In the illustrated embodiment, a radially outer-most edge 224 of the first segment 220 is flush with the radially outer-most edge 226 of the outer band 208 of the damper body 204. It will be appreciated that the projection 202 may be positioned radially inward on the outer band 208 of the damper body 204 so that the radially outer-most edge 224 of the first segment 220 is not flush with the radially outer-most edge 226 of the outer band 208 of the damper body 204.

In the illustrated embodiment, the projection 202 is coupled to and extends axially away from the outer band 208 opposite the contact face 206 of the outer band 208. In some embodiments, the projection 202 extends axially from the outer band 208 in a direction opposite a locator lip 230. The projection 202 is located axially between the outer band 208 and an inner band 240. In the illustrated embodiment, the projection 202 is located axially between the contact face 206 of an outer band 208 and the inner band 240. The projection 202 is sized and positioned to roll the outer band 208 of the damper 200 toward the rotor assembly 50 to retain contact between the contact face 206 of an outer band 208 and the engagement surface 66 of the rotor assembly 50 even as the contact face 206 wears.

Figure 5:
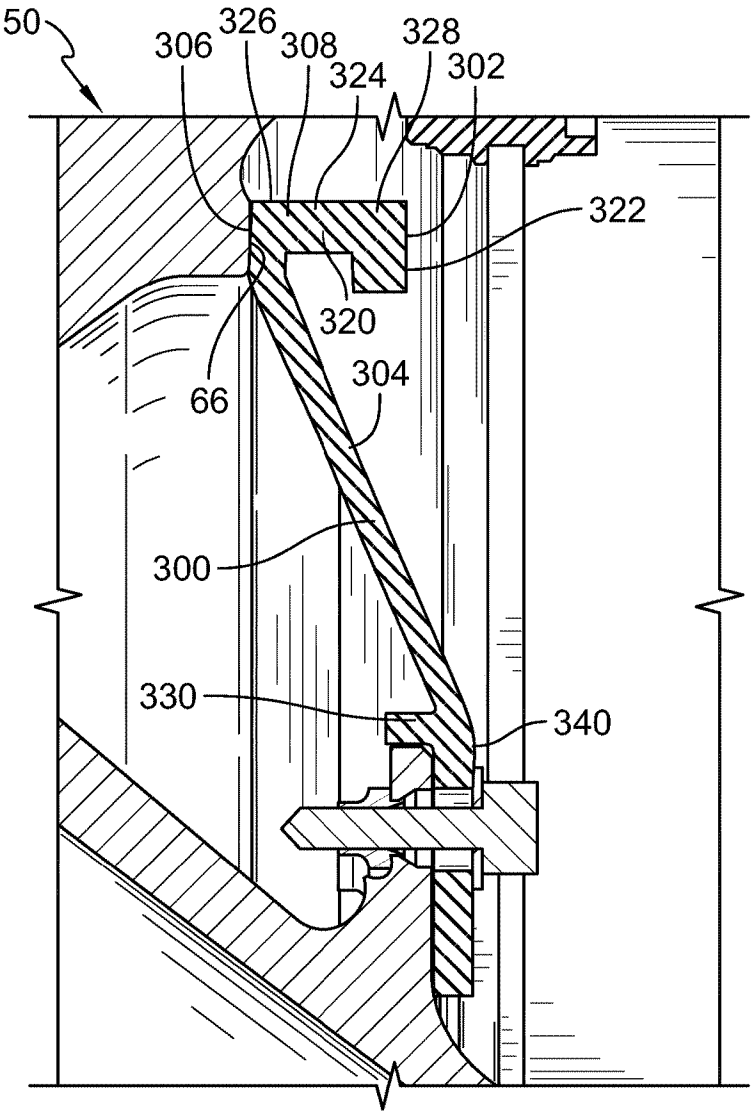
FIG. 5 is a perspective view of another damper, in accordance with yet another embodiment, including an L-shaped projection extending from the outer band of the damper.

FIG. 5 illustrates yet another embodiment of the damper rotor assembly 50 having damper 300 with a projection 302 extending axially from a damper body 304 to reinforce contact between a contact face 306 of an outer band 308 and the engagement surface 66 of the rotor assembly 50. In the embodiment of FIG. 5, the projection 302 is formed integrally with the damper 300. In other embodiments, the projection 302 may be bonded to the damper 300. The projection 302 is substantially L-shaped and includes a first segment 320 extending axially from the outer band 308 and a second segment 322 extending radially inward from the first segment 320.

In the illustrated embodiment, a radially outer-most edge 324 of the first segment 320 and a radially outer-most edge 328 of the second segment 322 are flush with the radially outer-most edge 326 of the outer band 308 of the damper body 304. It will be appreciated that the projection 302 may be positioned radially inward on the outer band 308 of the damper body 304 so that the radially outer-most edge 324 of the first segment 320 and the radially outer-most edge 328 of the second segment 322 are not flush with the radially outer-most edge 326 of the outer band 308 of the damper body 304. Moreover, the radially outer-most edge 324 of the first segment 320 and the radially outer-most edge 328 of the second segment 322 may be offset and not flush with one another.

In the illustrated embodiment, the projection 302 is coupled to and extends axially away from the outer band 308 opposite the contact face 306 of the outer band 308. In some embodiments, the projection 302 extends axially from the outer band 308 in a direction opposite a locator lip 330. The projection 302 is located axially between the outer band 308 and an inner band 340. In the illustrated embodiment, the projection 302 is located axially between the contact face 306 of an outer band 308 and the inner band 340. The projection 302 is sized and positioned to roll the outer band 308 of the damper 300 toward the rotor assembly 50 to retain contact between the contact face 306 of an outer band 308 and the engagement surface 66 of the rotor assembly 50 even as the contact face 306 wears.

Figure 6:
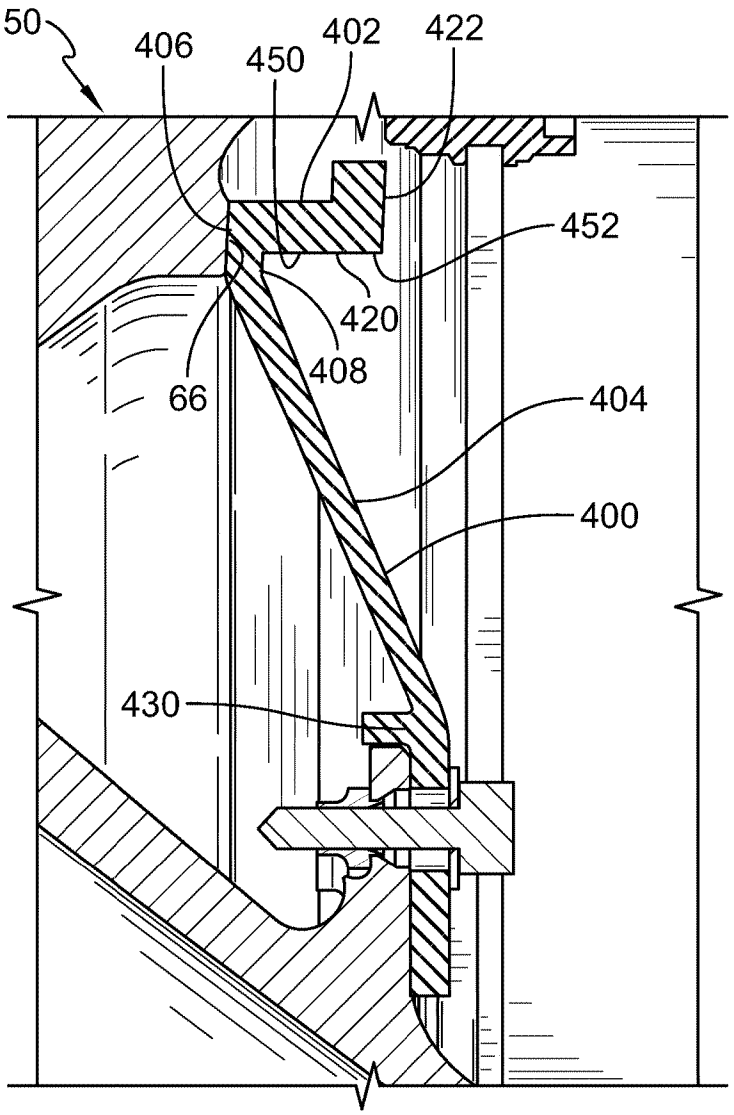
FIG. 6 is a perspective view of another damper, in accordance with a further embodiment, including another L-shaped projection extending from the outer band of the damper.

FIG. 6 illustrates a further embodiment of the damper rotor assembly 50 having a damper 400 with a projection 402 extending axially from a damper body 404 to reinforce contact between a contact face 406 of an outer band 408 and the engagement surface 66 of the rotor assembly 50. In the embodiment of FIG. 6, the projection 402 is formed integrally with the damper 400. In other embodiments, the projection 402 may be bonded to the damper 400. The projection 402 is substantially L-shaped and includes a first segment 420 extending axially from the outer band 408 and a second segment 422 extending radially outward from the first segment 420. In the illustrated embodiment, a radially inner-most edge 450 of the first segment 420 and a radially inner-most edge 452 of the second segment 422 are flush with one another. Additionally, the radially inner-most edge 450 of the first segment 420 and the radially inner-most edge 452 of the second segment 422 may be offset and not flush with one another. In the illustrated embodiment, the projection 402 is coupled to and extends axially away from the outer band 408 opposite the contact face 406 of the outer band 408.

The projection 402 is located axially between the outer band 408 and an inner band 440. In the illustrated embodiment, the projection 402 is located axially between the engagement surface 406 of the outer band 408 and the inner band 440. In some embodiments, the projection 402 extends axially from the outer band 408 in a direction opposite a locator lip 430. The projection 402 is sized and positioned to roll the outer band 408 of the damper 400 toward the rotor assembly 50 to retain contact between the contact face 406 of the outer band 408 and the engagement surface 66 of the rotor assembly 50 even as the contact face 406 wears.

Figure 7:
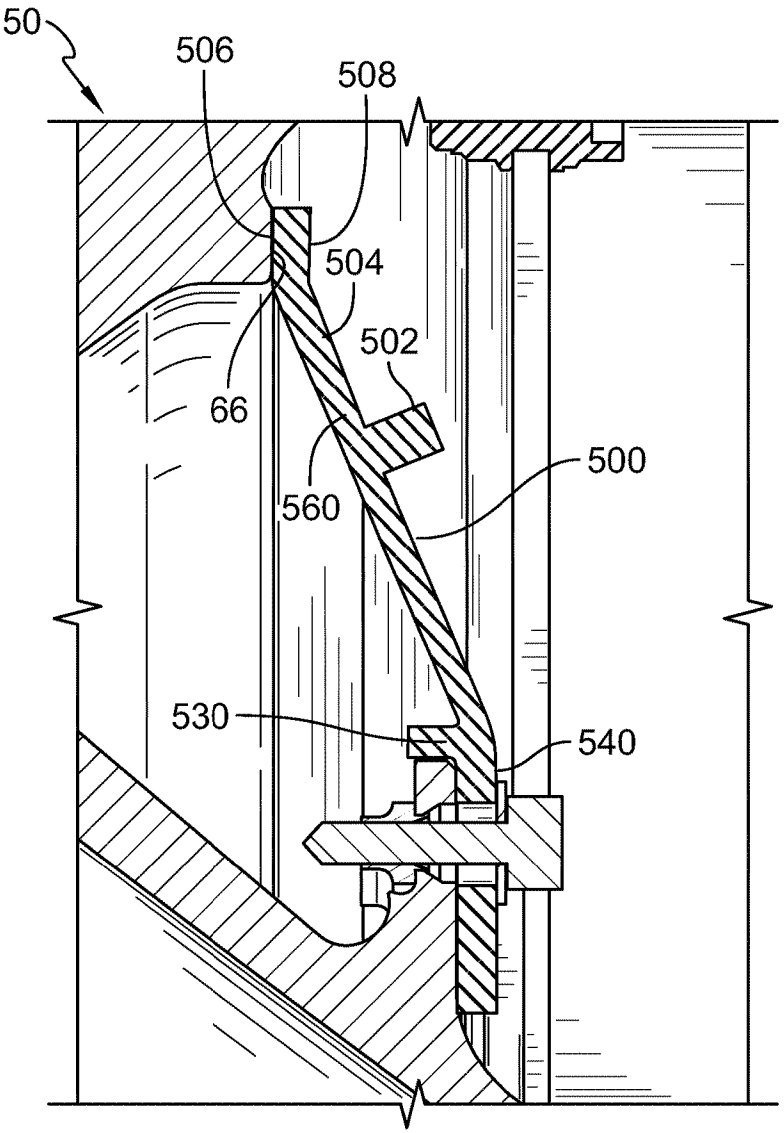
FIG. 7 is a perspective view of another damper, in accordance with an embodiment, including a rectangular projection extending from an intermediate band of the damper.

Referring to FIG. 7, a damper 500 includes a projection 502 that extends axially from a damper body 504 to reinforce contact between a contact face 506 of an outer band 508 and the engagement surface 66 of the rotor assembly 50. In the embodiment of FIG. 7, the projection 502 is formed integrally with the damper 500. In other embodiments, the projection 502 may be bonded to the damper 500. The projection 502 is substantially rectangular in shape and extends axially away from an intermediate band 560 opposite the contact face 506 of the outer band 508. It will be appreciated that in some embodiments, the projection 502 may extend axially away from the intermediate band 560 in the direction of the contact face 506. In some embodiments, the projection 502 extends axially from the intermediate band 560 in a direction opposite a locator lip 530; however, in other embodiments, the projection 502 may extend axially from the intermediate band 560 in the direction of the locator lip 530.

The projection 502 is located axially between the outer band 508 and an inner band 540. In the illustrated embodiment, the projection 502 is located axially between the engagement surface 506 of the outer band 508 and the inner band 540. The projection 502 is sized and positioned to roll the outer band 508 of the damper 500 toward the rotor assembly 50 to retain contact between the contact face 506 of the outer band 508 and the engagement surface 66 of the rotor assembly 50 even as the contact face 506 wears.

Figure 8:
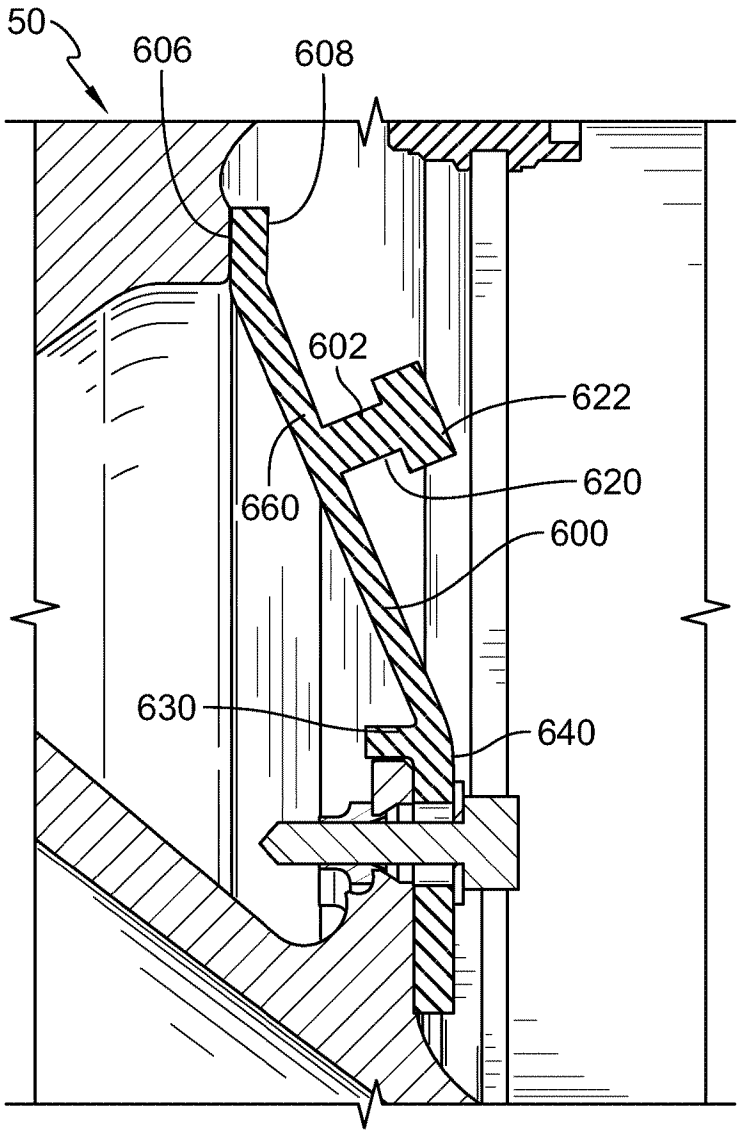
FIG. 8 is a perspective view of another damper, in accordance with another embodiment, including a T-shaped projection extending from the intermediate band of the damper.

FIG. 8 illustrates another embodiment of the damper rotor assembly 50 having a damper 600 with a projection 602 extending axially from a damper body 604 to reinforce contact between a contact face 606 of an outer band 608 and the engagement surface 66 of the rotor assembly 50. In the embodiment of FIG. 8, the projection 602 is formed integrally with the damper 600. In other embodiments, the projection 602 may be bonded to the damper 600. The projection 602 is substantially T-shaped and includes a first segment 620 extending axially from an intermediate band 660 and a second segment 622 extending both radially inward and radially outward from the first segment 620. In the illustrated embodiment, the projection 602 is coupled to and extends axially away from the intermediate band 660 opposite the contact face 606 of the outer band 608. It will be appreciated that in some embodiments, the projection 602 may extend axially away from the intermediate band 660 in the direction of the contact face 606.

In some embodiments, the projection 602 extends axially from the intermediate band 660 in a direction opposite a locator lip 630; however, in other embodiments, the projection 602 may extend axially from the intermediate band 660 in the direction of the locator lip 630. The projection 602 is located axially between the outer band 608 and an inner band 640. In the illustrated embodiment, the projection 602 is located axially between the engagement surface 606 of the outer band 608 and the inner band 640. The projection 602 is sized and positioned to roll the outer band 608 of the damper 600 toward the rotor assembly 50 to retain contact between the contact face 606 of the outer band 608 and the engagement surface 66 of the rotor assembly 50 even as the contact face 606 wears.

Figure 9:
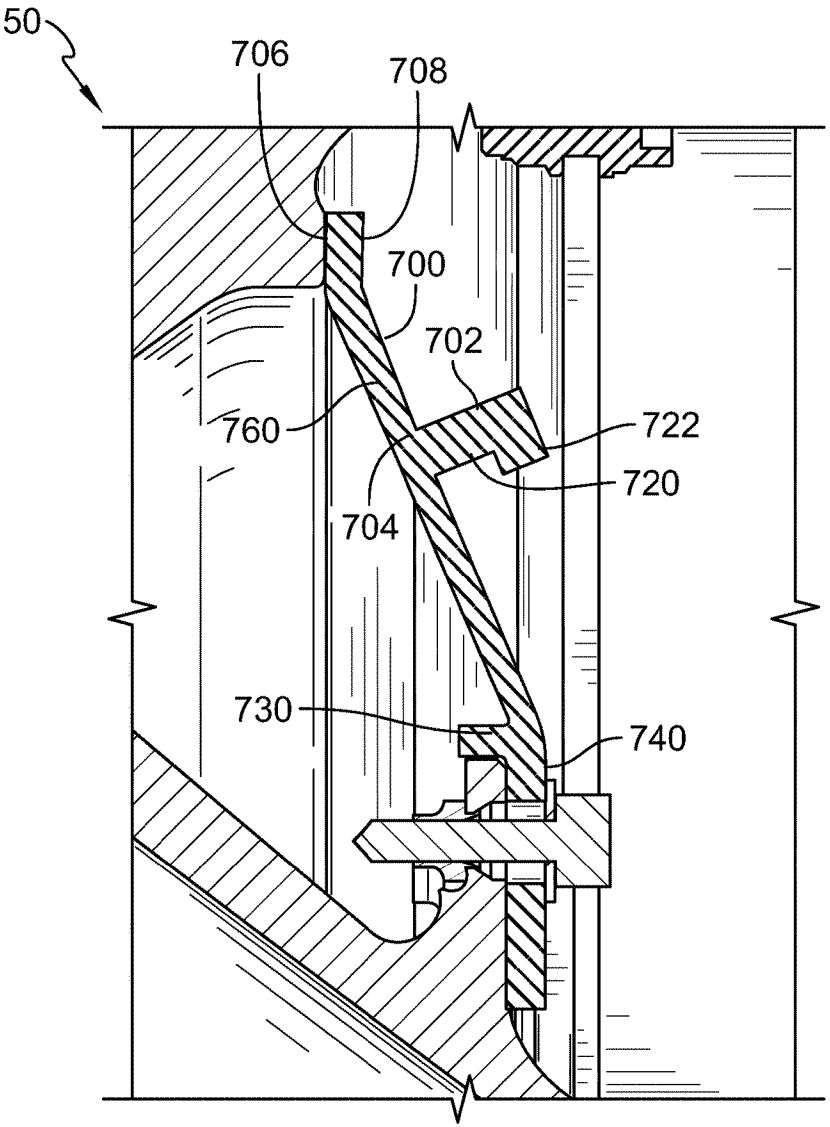
FIG. 9 is a perspective view of another damper, in accordance with yet another embodiment, including an L-shaped projection extending from the intermediate band of the damper.

FIG. 9 illustrates yet another embodiment of the damper rotor assembly 50 including a damper 700 having a projection 702 extending axially from a damper body 704 to reinforce contact between a contact face 706 of an outer band 708 and the engagement surface 66 of the rotor assembly 50. In the embodiment of FIG. 9, the projection 702 is formed integrally with the damper 700. In other embodiments, the projection 702 may be bonded to the damper 700.

The projection 702 is substantially L-shaped and includes a first segment 720 extending axially from an intermediate band 760 and a second segment 722 extending radially inward from the first segment 720. In the illustrated embodiment, the projection 702 is coupled to and extends axially away from the intermediate band 760 opposite the contact face 706 of the outer band 708. It will be appreciated that in some embodiments, the projection 702 may extend axially away from the intermediate band 760 in the direction of the contact face 706. In some embodiments, the projection 702 extends axially from the intermediate band 760 in a direction opposite a locator lip 730; however, in other embodiments, the projection 702 may extend axially from the intermediate band 760 in the direction of the locator lip 730. The projection 702 is located axially between the outer band 708 and an inner band 740.

In the illustrated embodiment, the projection 702 is located axially between the engagement surface 706 of the outer band 708 and the inner band 740. The projection 702 is sized and positioned to roll the outer band 708 of the damper 700 toward the rotor assembly 50 to retain contact between the contact face 706 of the outer band 708 and the engagement surface 66 of the rotor assembly 50 even as the contact face 706 wears.

Figure 10:
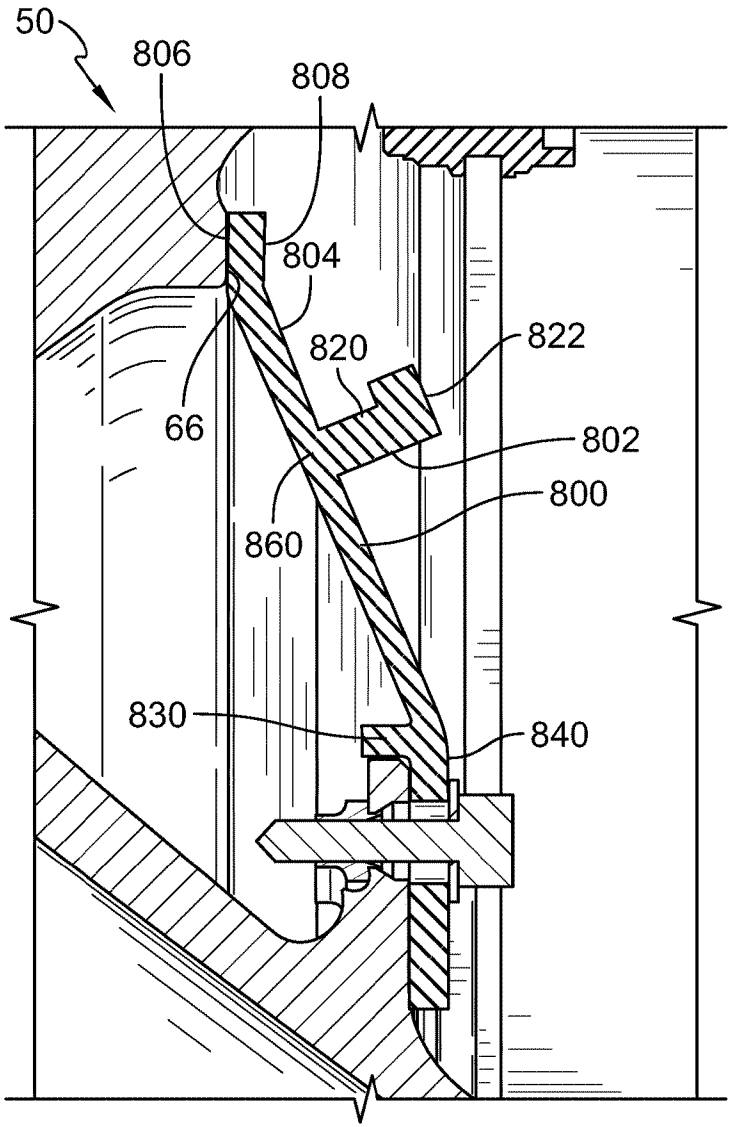
FIG. 10 is a perspective view of another damper, in accordance with a further embodiment, including another L-shaped projection extending from the intermediate band of the damper.

FIG. 10 illustrates a further embodiment of the damper rotor assembly 50 including a damper 800 having a projection 802 extending axially from a damper body 804 to reinforce contact between a contact face 806 of an outer band 808 and the engagement surface 66 of the rotor assembly 50. In the embodiment of FIG. 10, the projection 802 is formed integrally with the damper 800. In other embodiments, the projection 802 may be bonded to the damper 800.

The projection 802 is substantially L-shaped and includes a first segment 820 extending axially from the outer band 808 and a second segment 822 extending radially outward from the first segment 820. In the illustrated embodiment, the projection 802 is coupled to and extends axially away from an intermediate band 860 opposite the contact face 806 of the outer band 808. It will be appreciated that in some embodiments, the projection 802 may extend axially away from the intermediate band 860 in the direction of the contact face 806. In some embodiments, the projection 802 extends axially from the intermediate band 860 in a direction opposite a locator lip 830; however, in other embodiments, the projection 802 may extend axially from the intermediate band 860 in the direction of the locator lip 830.

The projection 802 is located axially between the outer band 808 and an inner band 840. In the illustrated embodiment, the projection 802 is located axially between the engagement surface 806 of the outer band 80 and the inner band 840. The projection 802 is sized and positioned to roll the outer band 808 of the damper 800 toward the rotor assembly 50 to retain contact between the contact face 806 of the outer band 808 and the engagement surface 66 of the rotor assembly 50 even as the contact face 806 wears.

While the disclosure has been illustrated and described in detail end in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A rotor assembly for a gas turbine engine comprising:

a rotor extending circumferentially about a central axis, wherein the rotor includes a ring that extends around the central axis and a mount that extends axially away from the ring, the ring including an axially facing engagement surface, a blade extending radially outward from the ring of the rotor, and a damper coupled with the mount of the rotor with a fastener and engaged with the engagement surface to minimize vibrations of the rotor assembly, the damper including an inner band fixed with the mount, a damper body that extends radially outward and axially into engagement with the engagement surface of the rotor, and a projection that extends axially from the damper body away from the engagement surface such that the projection is located axially between the engagement surface and the inner band to urge the damper body into the engagement surface as a result of centripetal forces in response to rotation of the rotor assembly about the central axis, wherein the damper body further includes an outer band and an intermediate band, the outer band extends substantially radially and is engaged with the engagement surface, and the intermediate band extends radially and axially to interconnect the inner band and the outer band, wherein the damper further includes a locator lip that extends axially away from the inner band and is engaged with a radially outward facing contact surface of the mount such that the locator lip is located radially outward of the contact surface, and wherein the intermediate band is spaced apart from the rotor such that the damper body is not engaged with the rotor radially between the outer band and the locator lip such that the projection urges a radial outer end of the damper axially toward the ring causing the intermediate band to act as a lever arm due to a weight of the projection being acted on by centripetal forces during use of the rotor assembly.

2. The rotor assembly of claim 1, wherein the projection is coupled with and extends axially away from the outer band.

3. The rotor assembly of claim 2, wherein the locator lip extends axially away from the intermediate band in a direction opposite the projection.

4. The rotor assembly of claim 1, wherein the projection is coupled with and extends axially away from the intermediate band.

5. The rotor assembly of claim 1, wherein the projection is substantially rectangular shaped.

6. The rotor assembly of claim 1, wherein a radially outer-most edge of the projection is flush with a radially outer-most edge of the damper body.

7. The rotor assembly of claim 1, wherein the projection is substantially L-shaped.

8. The rotor assembly of claim 1, wherein the projection is substantially T-shaped.

9. A rotor assembly for a gas turbine engine comprising:

a rotor extending circumferentially about a central axis, wherein the rotor includes a ring that extends around the central axis and a mount that extends axially away from the ring, and a damper that includes an inner band fixed with the mount, a damper body that extends radially outward and axially into engagement with the ring of the rotor, and a projection that extends axially from the damper body away from the ring, wherein the damper body includes an outer band and an intermediate band, the outer band extends substantially radially and is engaged with the ring and the intermediate band extends radially and axially between and directly interconnects the inner band and the outer band such that the projection and the intermediate band are located axially between the inner and outer bands, wherein the entire projection is located axially between the outer band and the inner band, and wherein the intermediate band is spaced apart from the rotor such that the damper body is not engaged with the rotor radially between the outer band and the inner band to cause the projection to urge the outer band of the damper body axially toward the ring causing the intermediate band to act as a lever arm due to a weight of the projection being acted on by centripetal forces during use of the rotor assembly.

10. The rotor assembly of claim 9, wherein the projection is coupled with and extends axially away from the outer band.

11. The rotor assembly of claim 10, wherein the damper further includes a locator lip that extends axially away from the inner band and the intermediate band in a direction opposite the projection.

12. The rotor assembly of claim 9, wherein the projection is coupled with and extends axially away from the intermediate band.

13. The rotor assembly of claim 9, wherein the projection is substantially rectangular shaped.

14. The rotor assembly of claim 9, wherein a radially outer-most edge of the projection is flush with a radially outer-most edge of the damper body.

15. The rotor assembly of claim 9, wherein the projection is substantially L-shaped.

16. The rotor assembly of claim 9, wherein the projection is substantially T-shaped.

17. The rotor assembly of claim 9, wherein the damper further includes a locator lip that extends axially away from the inner band and is engaged with a radially outward facing contact surface of the mount such that the locator lip is located radially outward of the contact surface.

18. The rotor assembly of claim 17, wherein the damper body is not engaged with the rotor radially between the outer band and the locator lip.

19. The rotor assembly of claim 9, wherein the damper is coupled to the mount by a fastener.

* * * * *